US005775805A

United States Patent [19]

Furuya

[11] Patent Number: 5,775,805

[45] Date of Patent: Jul. 7, 1998

[54] DEVICE FOR MIXING GRANULAR MEDICINES TOGETHER

[75] Inventor: Mitsumasa Furuya, 8-18 Haruecho, 2-chome, Edogawa-ku, Tokyo, Japan, 132

[73] Assignees: Takamasa Shirai, Dove Canyon, Calif.; Mitsumasa Furuya, Tokyo, Japan

[21] Appl. No.: 791,160

[22] Filed: Jan. 30, 1997

[30] Foreign Application Priority Data

May 30, 1996 [JP] Japan ..... 8-005867 U

[51] Int. Cl.[6] ..... B01F 5/06

[52] U.S. Cl. ..... 366/130; 366/336; 366/340; 206/219

[58] Field of Search ..... 366/336, 340, 366/341, 349, 130, 337, 219; 206/219

[56] References Cited

U.S. PATENT DOCUMENTS

| | | | |
|---|---|---|---|
| 269,742 | 12/1882 | Taggart | 366/340 |
| 2,593,425 | 4/1952 | Evans | 366/340 |
| 3,476,521 | 11/1969 | Wise | 366/336 |
| 5,330,267 | 7/1994 | Tauscher . | |
| 5,425,581 | 6/1995 | Palm . | |
| 5,456,533 | 10/1995 | Streiff et al. . | |

FOREIGN PATENT DOCUMENTS

| | | | |
|---|---|---|---|
| 86509 | 11/1993 | Japan . | |
| 29624 | 4/1994 | Japan . | |
| 256076 | 10/1995 | Japan . | |
| 1118398 | 10/1984 | U.S.S.R. | 366/341 |

*Primary Examiner*—Tony G. Soohoo
*Attorney, Agent, or Firm*—Jacobson, Price, Holman & Stern, PLLC

[57] ABSTRACT

A container for mixing two or more kinds of granular medicines or the like together without breaking their granular shapes. Prisms are arranged in the container in lines on the bottom in such a manner that their vertical edges are directed toward the relative side walls of the container and the prisms arranged in each line are located at intermediate positions between the adjacent prisms arranged in the next line. When the container is inclined, objects to be mixed together, which are inserted in the container, travel on the bottom of the container and are divided into two flows by an edge of each of the prisms arranged in a line, and the objects to be mixed together which flow along opposed sides of each of the prisms are joined together in the intermediate portions between the adjacent prisms, and the joined objects are again divided into two flows by an edge of each of the prisms arranged in the next line. The objects are mixed together by repeating such an action.

1 Claim, 2 Drawing Sheets

DEVICE FOR MIXING GRANULAR MEDICINES TOGETHER

FIELD OF THE INVENTION

The present invention relates to a mixing device capable of uniformly mixing two or more kinds of granular medicines or the like together without breaking their granular shapes.

THE PRIOR ART

A conventional device for mixing solids together is arranged to perform a mixing operation, as by using a stirring instrument for stirring an object accommodated in a container, or by rotating the container itself. Such a conventional device has a large size, and if a granular object is stirred, the granular object may be broken.

BACKGROUND OF THE INVENTION

To solve the above-described problems of the conventional mixing device, the present invention is intended to provide a device for mixing granular medicines together which has a small size and a simple construction, can efficiently mix objects together and is easy to handle without causing breakage of the objects to be mixed together.

BRIEF SUMMARY OF INVENTION

An object of the present invention is to make it possible to mix two or more kinds of granular medicines or the like together without breaking their granular shapes.

To achieve the above object, prisms are arranged in lines on the bottom of a flat container in such a manner that their vertical edges are perpendicularly directed toward the relative side walls of the container and the prisms arranged in each line are located at the intermediate positions between the adjacent prisms arranged in the next line. When the container is inclined, objects to be mixed together, which are inserted in the container, travel on the bottom of the container and are divided into two flows by an edge of each of the prisms arranged in a line, and the objects to be mixed together which flow along opposed sides of each of the prisms are joined together in the intermediate portions between the adjacent prisms, and the joined and mixed objects are again divided into two flows by an edge of each of the prisms arranged in the next line. The objects are mixed together by repeating such an action.

BRIEF DESCRIPTION OF THE INVENTION

Figure 1A:
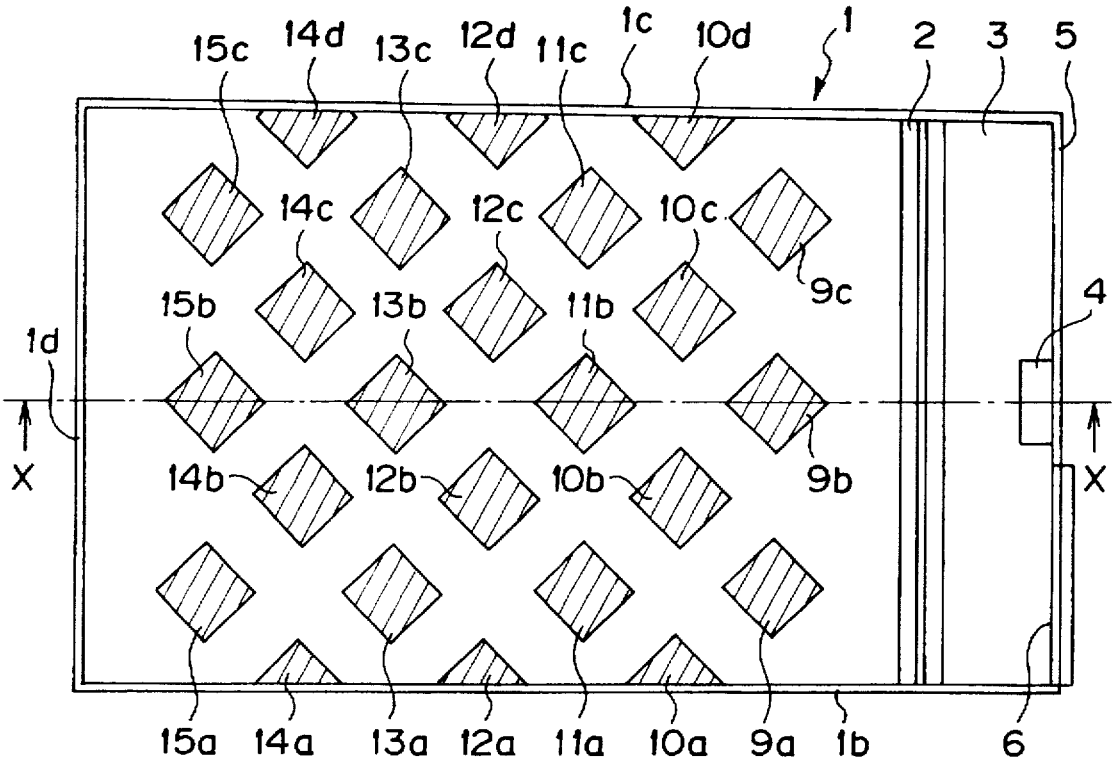
FIGS. 1(*a*)–1(*b*) show a mixing device for mixing granular medicines together according to the present invention, and part (a) is a plan view and part (b) is a cross-sectional view taken along line X—X of part (a).
Figure 1B:
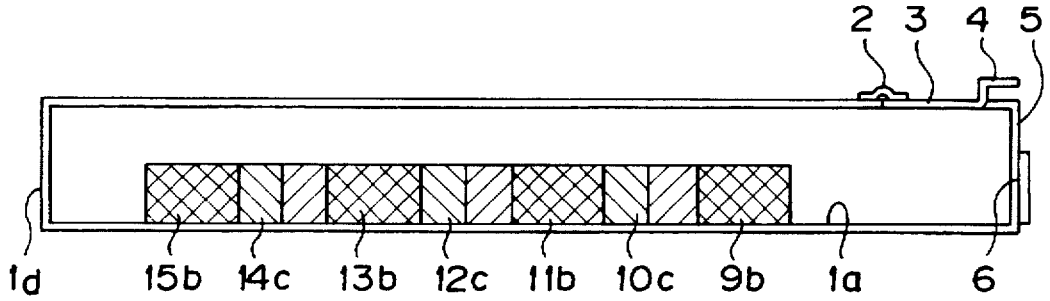
Figure 2:
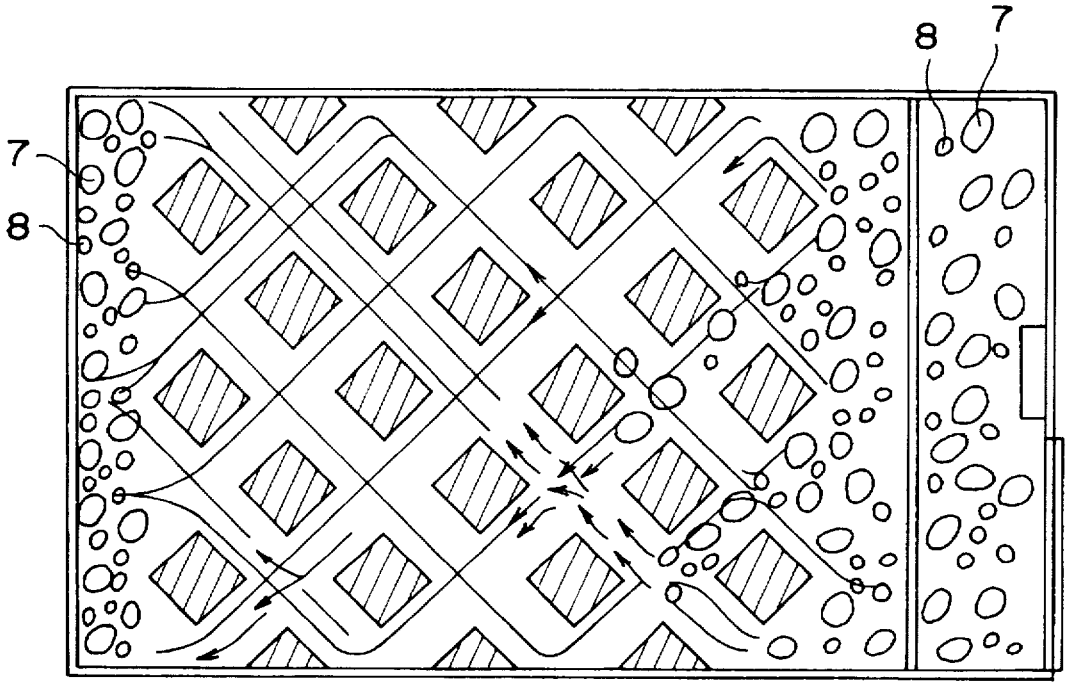
FIG. 2 is an explanatory view showing the state of movement and mixing of granular medicines to be mixed together in the mixing device of the present invention.

Referring to FIG. 1, a lid 3 is provided on the lengthwise right side of the top of a flat container 1 which has a rectangular shape in plan view so that the lid 3 can be opened and closed by the upward and downward bending of a rubber hinge 2. If the lid 3 is opened, objects to be mixed together can be put into or taken out of the container 1. Reference numeral 4 denotes a knob provided on the lid 3.

Incidentally, a discharge port 6 may be provided in a side wall 5 on the side of the container 1 on which the lid 3 is provided.

As shown in part (a) of FIG. 1, a multiplicity of prisms are fixed to a container bottom la on the left side of the rubber hinge 2 for the lid 3 which can be opened and closed by the upward and downward bending of the hinge 2. The prisms are spaced apart from each other at equal intervals and aligned in the direction of 45°, and each of the prisms has diagonal lines which are respectively parallel to and perpendicular to the lengthwise axis of the container 1. Regarding the height of the prisms, the prisms need only be higher than objects 7 and 8 to be mixed together when the objects travel in the container 1 while flowing on the container bottom 1*a*.

Specifically, after the objects 7 and 8 to be mixed together are put into the container 1 through a portion at which the lid 3 is located, if the container 1 is inclined by lifting the side of the container 1 on which the lid 3 is provided, the objects 7 and 8 to be mixed together strike on the right edges of a plurality of prisms 9*a*, 9*b* and 9*c* which are arranged in a line, so that the objects 7 and 8 are divided into two flows by each of the right edges and these two flows travel along opposite faces of each of the prisms 9*a*, 9*b* and 9*c* on the container bottom 1*a*. Then, the objects 7 and 8 pass through the intermediate portions between the adjacent prisms 9*a*, 9*b* and 9*c* while being guided along the side faces thereof. Thus, the objects 7 and 8 are joined and mixed with each other near the right edges of prisms 10*a*, 10*b*, 10*c* and 10*d* which are arranged in a line at the rear of the prisms 9*a*, 9*b* and 9*c* and at the middle positions between the adjacent ones of the prisms 9*a*, 9*b* and 9*c*. The objects 7 and 8 which are mixed together in this state are again divided into two flows by the right edges of the prisms 10*a*, 10*b*, 10*c* and 10*d*, and the two flows travel along opposite faces of each of the prisms 10*a*, 10*b*, 10*c* and 10*d*. Incidentally, each of the prisms 10*a* and 10*d* is cut along one of its diagonal lines, and the cut faces of the respective prisms 10*a* and 10*d* are respectively stuck to side wall 1*b* and 1*c* of the container 1.

The above-described processes, that is, the division of the objects 7 and 8 by the right edges of the respective prisms 9*a* to 9*c*, the flowing of the objects 7 and 8 along the side faces of each of the prisms 9*a* to 9*c*, the joining and mixing of the objects 7 and 8 near the right edges of the respective prisms 10*a* to 10*d* disposed in a line at the rear of the prisms 9*a* to 9*c* and at the middle positions between the adjacent ones of the prisms 9*a* to 9*c*, and the division of the mixture of the objects 7 and 8 at the right edges of the respective prisms 10*a* to 10*d*, are repeated as many times as the number of lines of prisms 11*a* to 11*c*, 12*a* to 12*d*, 13*a* to 13*c*, 14*a* to 14*d* and 15*a* to 15*c*. Since the prisms are arranged in a plurality of lines in the direction of flow of the objects 7 and 8, the objects 7 and 8 are divided into two flows at each line of prisms and joined together and divided at the next line of prisms, in a repetitive manner.

When the objects 7 and 8 reach a side wall 1*d* of the container 1 which is opposite to the lid 3, the lid side of the container 1 is inclined downward to make the objects 7 and 8 flow in the direction opposite to the direction of flow in the above-described mixing action, whereby the objects 7 and 8 are repeatedly divided and joined by the edges of the respective prisms that are opposite to the right edges used in the above-described operation. If the aforesaid mixing action for the objects 7 and 8 is repeatedly performed by swinging up and down the lengthwise right and left sides of the container 1, it is possible to securely and efficiently mix the objects 7 and 8 together.

If the container 1 is swung about the axis of line X—X of FIG. 1 with the objects 7 and 8 located in a central portion of the container 1, the objects 7 and 8 can be mixed together in a manner similar to the aforesaid mixing action by opposite edges of each of the prisms.

After the container 1 is swung a predetermined number of times, the mixture of the objects 7 and 8 may be discharged from the container 1 through an opening available when the lid 3 is opened or through the discharge port 6 provided in the side wall 5 of the container 1 on the side of the lid 3.

Incidentally, the arrangement of the prisms on the container bottom is not limited to the above-described example, and the prisms may be arranged in any form as long as objects to be mixed together can be divided into two flows by edges of the prisms arranged in each line and the flows can be joined and again divided by edges of the prisms arranged in the next line.

In accordance with the present invention, the objects 7 and 8 to be mixed together are put into the container 1 through the portion at which the lid 3 is provided, and after the lid 3 is closed, the container 1 is swung so that the objects 7 and 8 are divided into two flows at an edge of each of the prisms arranged in each line on the container bottom and are joined and again divided at an edge of each of the prisms arranged in the next line. Accordingly, a multiplicity of mixing actions are effected so that the objects 7 and 8 are sufficiently mixed together.

In addition, since the objects 7 and 8 to be mixed together gently travel along the inclined container bottom and are subject to the mixing actions, even fragile granular medicines can be securely mixed together without breakage.

Although in the above-described embodiment two kinds of objects are mixed together, more than two kinds of objects can likewise be mixed together. In addition, any other solid that is not granular but can flow on the container bottom can likewise be mixed together.

What is claimed is:

1. A device for mixing granular medicines together, said device comprising:

a flat box-shaped container having four sides, with opposed sides being parallel to each other, and top with a flat interior surface and a bottom with an interior surface, a multiplicity of prisms, each of said prisms having four sides and edges formed at an intersection of two adjacent sides and opposed sides of each prism being parallel with each other to form two sets of parallel sides, said prisms being fixed to the interior surface of the bottom of the flat box-shaped container, said prisms being aligned in a plurality of rows and columns with a same edge of each prism of all of the prisms in a same row lying along a first axis, said first axis extending in parallel with two of the four sides of said box-shaped container and a same edge of each prism of all of the prisms in a same column lying along a second axis, said second axis extending in parallel with the other two of the four sides of said box shaped container, all sides of said prisms extending in oblique directions with respect to the sides of the container, and one of said four sides of said container forming a portion of the container through which medicines can be inserted to be mixed and mixed medicines can be discharged therefrom, said box shaped container being swingable about at least one of said first axis and said second axis for mixing of medicines inserted into the box-shaped container by dividing the medicines into two flows by an edge of each of said prisms arranged in a column or a row, and said two flows traveling along sides of each of said prisms and are joined together and the joined medicines are again divided into two separate flows by an edge of each of said prisms arranged in a next lower row or column, such separation and mixing being repeatedly performed.

* * * * *